US006007117A

United States Patent [19]

Spindler

[11] Patent Number: 6,007,117

[45] Date of Patent: Dec. 28, 1999

[54] MOTOR VEHICLE DOOR LOCK OR THE LIKE WITH TRIP-FREE MECHANISM

[75] Inventor: Joerg Spindler, Wie Postenschrift, Germany

[73] Assignee: Robert Bosch GmbH, Stuttgart, Germany

[21] Appl. No.: 08/970,717

[22] Filed: Nov. 14, 1997

[30] Foreign Application Priority Data

Dec. 3, 1996 [DE] Germany ..... 196 50 136

[51] Int. Cl.[6] ..... E05C 3/06

[52] U.S. Cl. ..... 292/199; 292/216; 74/435; 70/237

[58] Field of Search ..... 292/51, 142, 172, 292/199, 216, DIG. 62; 70/237, DIG. 42; 74/435

[56] References Cited

U.S. PATENT DOCUMENTS

| | | | |
|---|---|---|---|
| 1,058,166 | 4/1913 | Evans | 70/237 |
| 3,882,735 | 5/1975 | Shimodaira et al. | 74/435 |
| 3,990,281 | 11/1976 | Meder | 70/DIG. 42 |
| 4,093,289 | 6/1978 | Inabayashi et al. | 292/201 |
| 4,272,112 | 6/1981 | Schlick et al. | 292/201 |
| 4,384,465 | 5/1983 | Muus | 292/DIG. 27 |
| 4,518,180 | 5/1985 | Kleefeldt et al. | 292/216 |
| 4,735,447 | 4/1988 | Kleefeldt | 292/201 |
| 4,793,640 | 12/1988 | Stewart, Sr. | 292/201 |
| 4,875,362 | 10/1989 | Nozawa et al. | 74/435 |
| 4,948,183 | 8/1990 | Yamada | 292/201 |
| 5,050,410 | 9/1991 | Claar et al. . | |
| 5,265,452 | 11/1993 | Dawson et al. | 70/278 |
| 5,284,064 | 2/1994 | Green et al. | 74/435 |
| 5,603,539 | 2/1997 | Gruhn | 70/237 |

FOREIGN PATENT DOCUMENTS

| | | | |
|---|---|---|---|
| 2172753 | 9/1986 | United Kingdom | 70/237 |

*Primary Examiner*—Teri Pham

*Attorney, Agent, or Firm*—Sixbey, Friedman, Leedom & Ferguson; David S. Safran

[57] ABSTRACT

A motor vehicle door lock or the like for a door or hatch of a motor vehicle which can be closed from the outside, preferably via a closing cylinder, with a lock mechanism which, among other elements, has an actuating lever (1), a force application element (4) which moves actuating lever (1), and an intermediate element (5) which is moved away from the closing cylinder or the like, the force application element (4) and intermediate element (5) being made as gear wheels with gear rims (6, 7) which are transmission-coupled to one another. A trip-free mechanism is easily integrated by the gear rim of one of the gear wheels having a gap (8) and thus the intermediate element (5) is able to continue to be turned in idle when this gap (8) is reached without the force application element (4) itself continuing to turn along with it. It is especially advantageous if the transmission element (9) is a gear wheel located between the force application element (4) and the intermediate element (5) and engages the force application element (4) and the intermediate element (5) with the gap (8) being in the gear rim (10) of the transmission element (9).

6 Claims, 6 Drawing Sheets

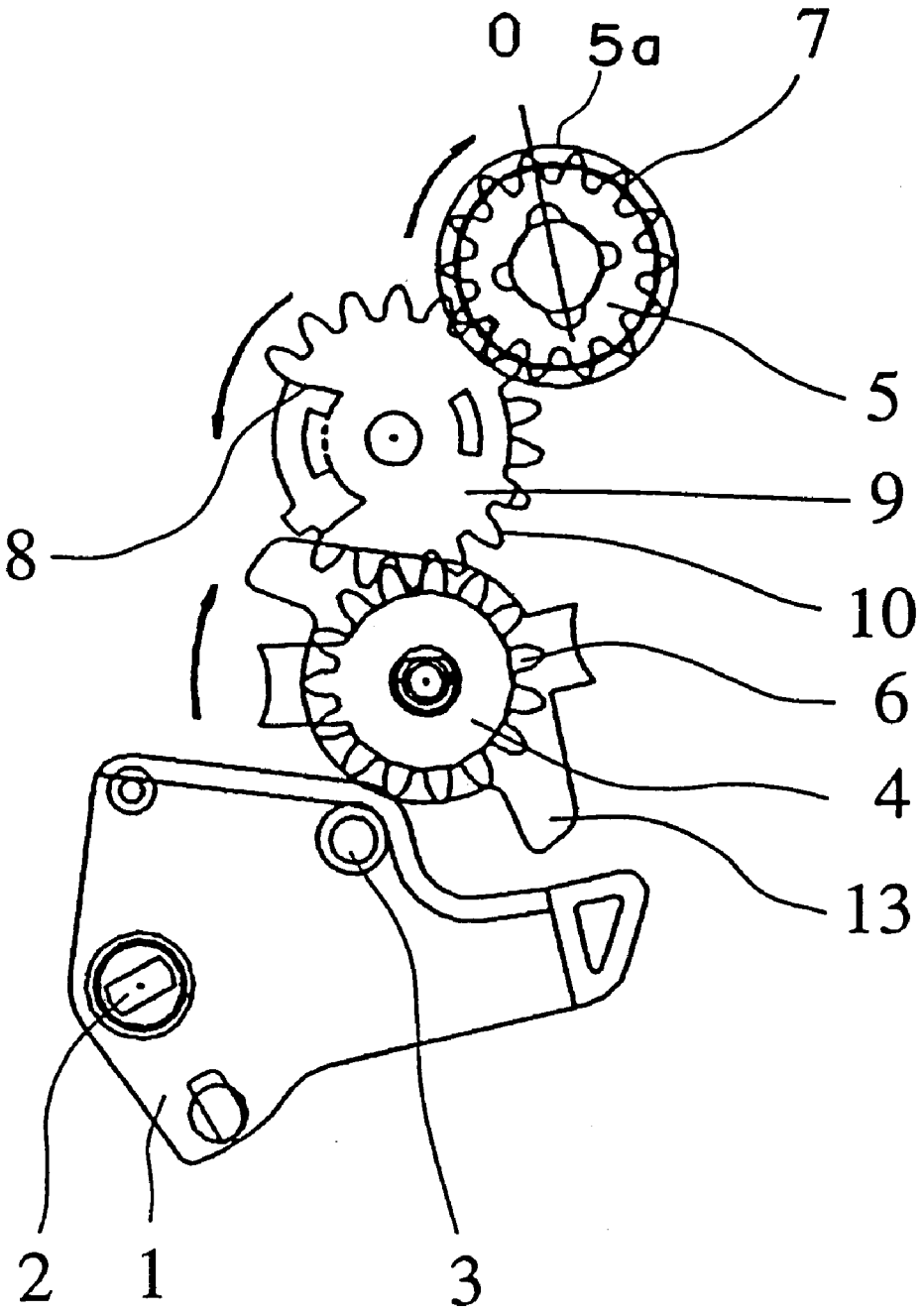
Fig. 2.1

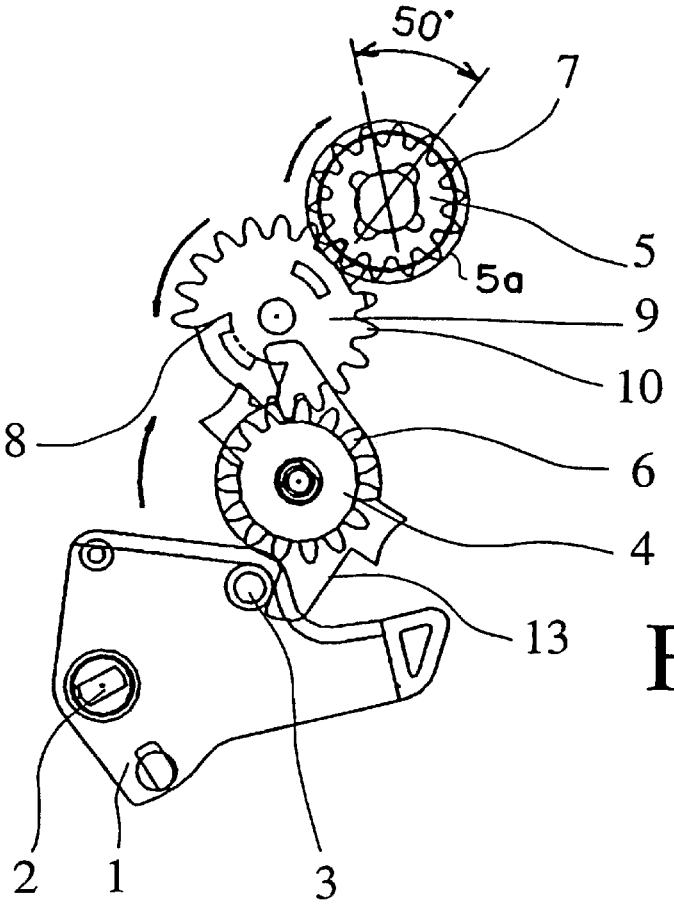
Fig. 2.2
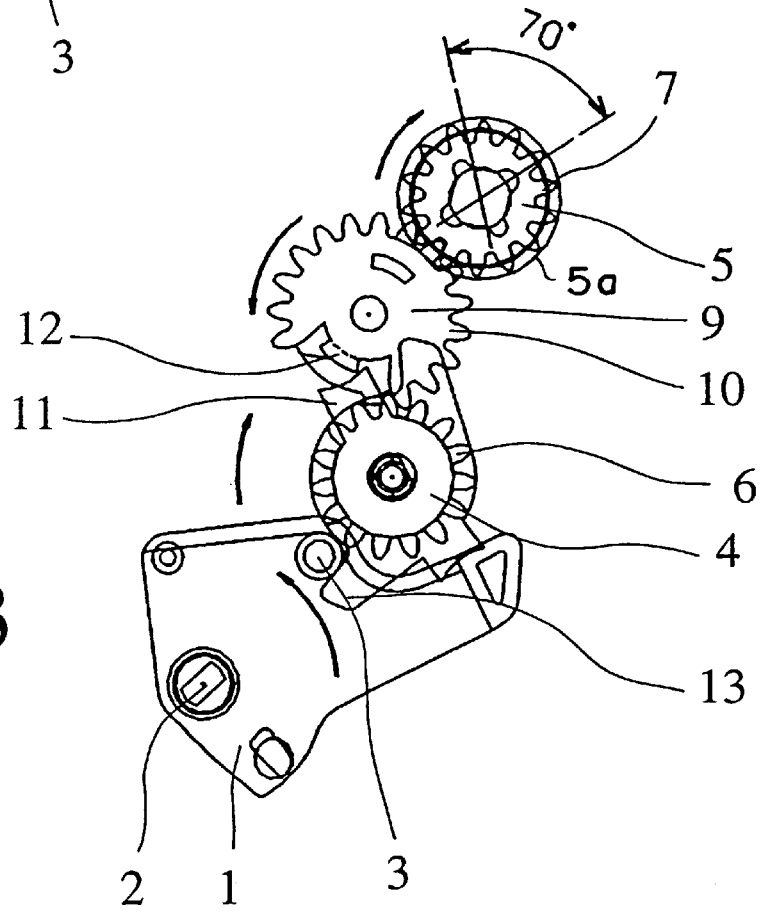
Fig. 2.3

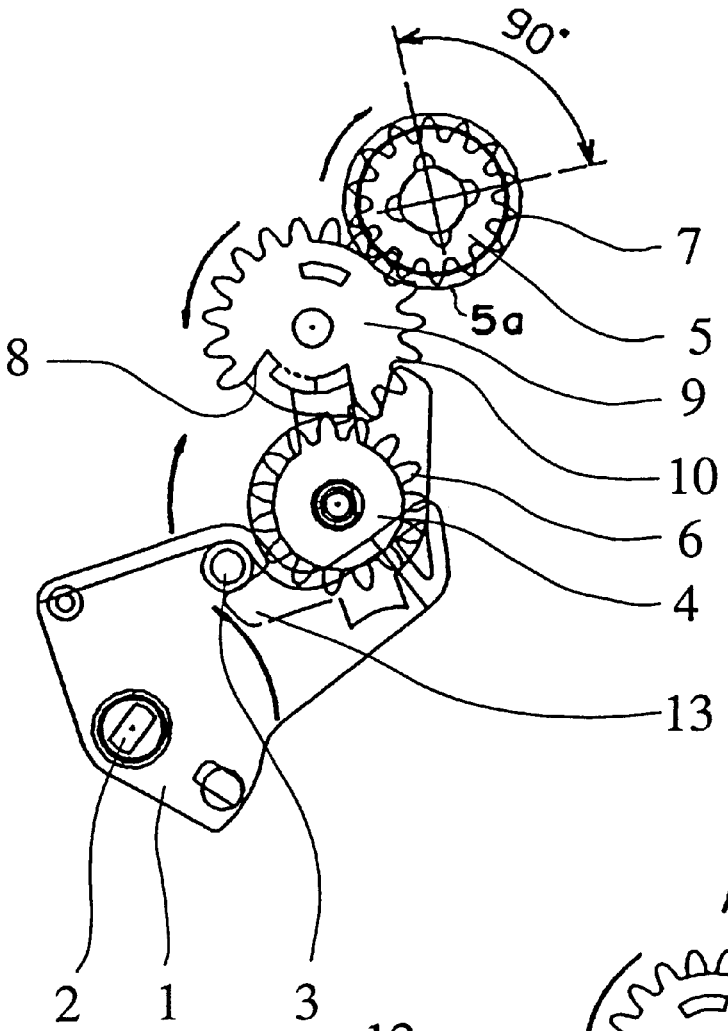
Fig. 2.4
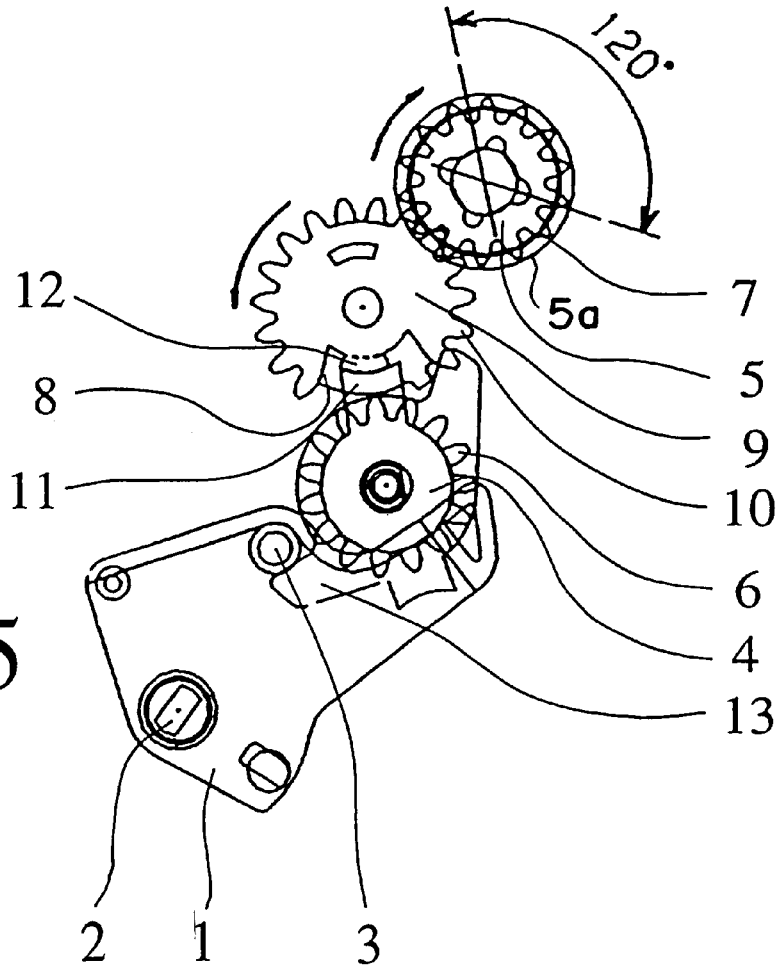
Fig. 2.5

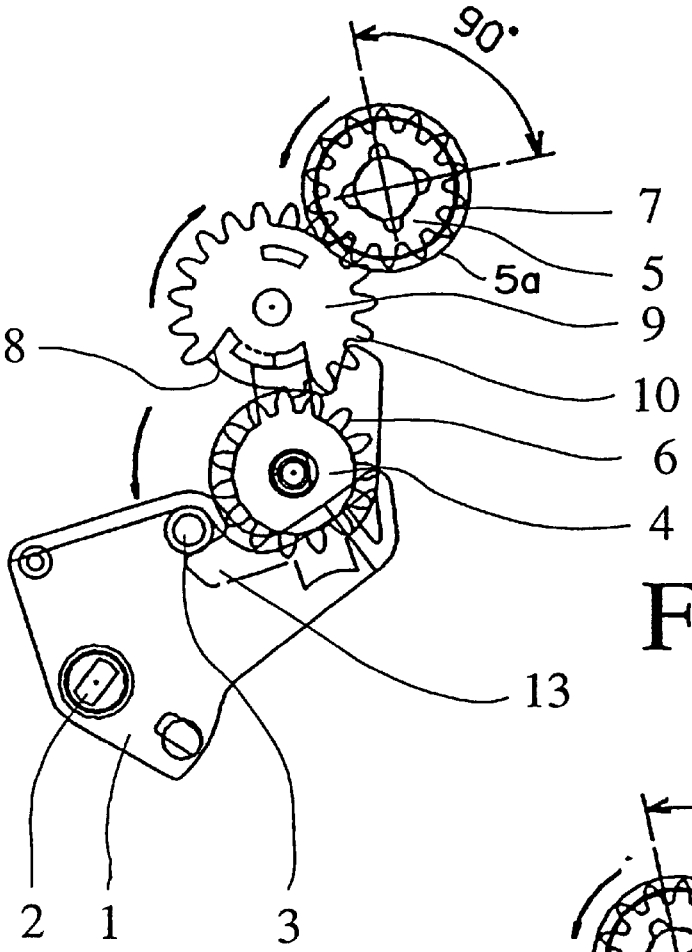
Fig. 2.6
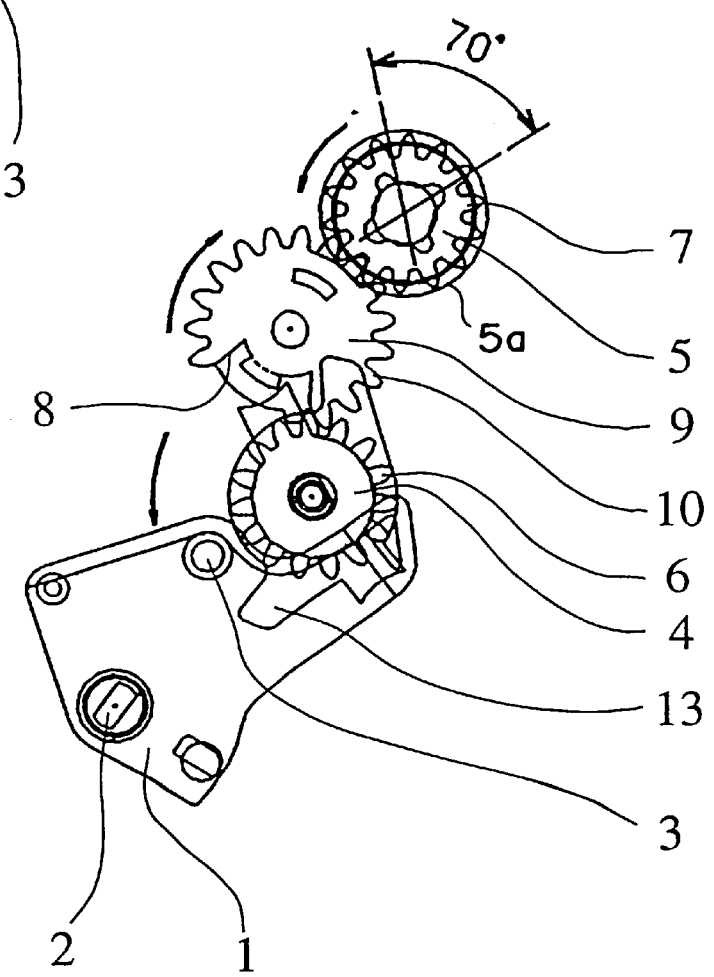
Fig. 2.7

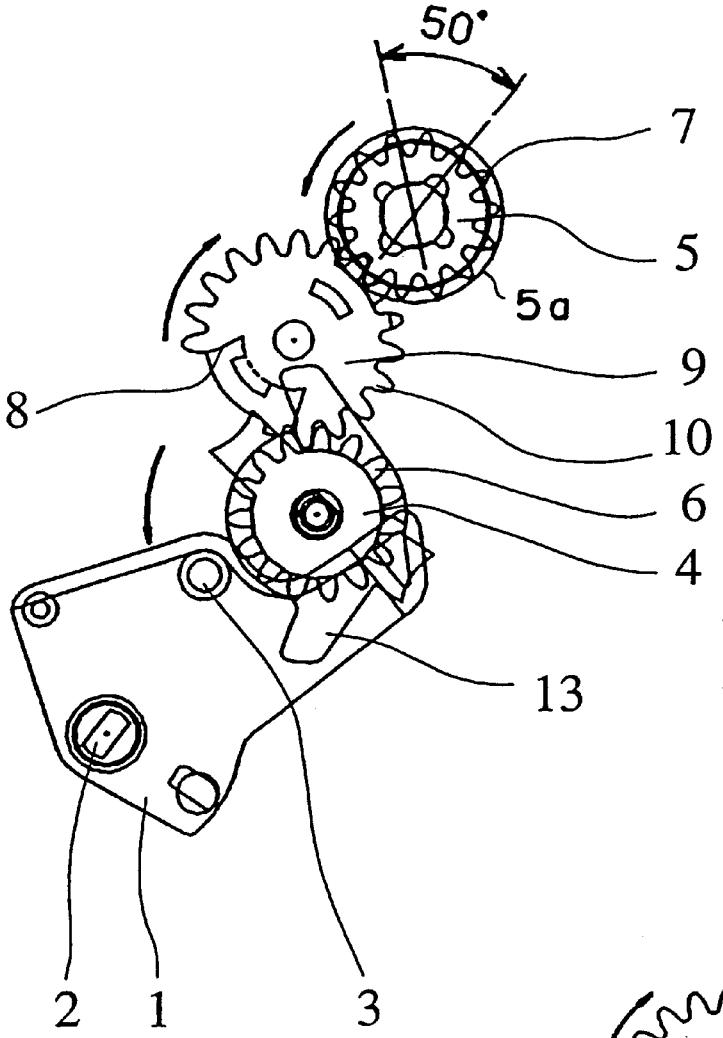
Fig. 2.8
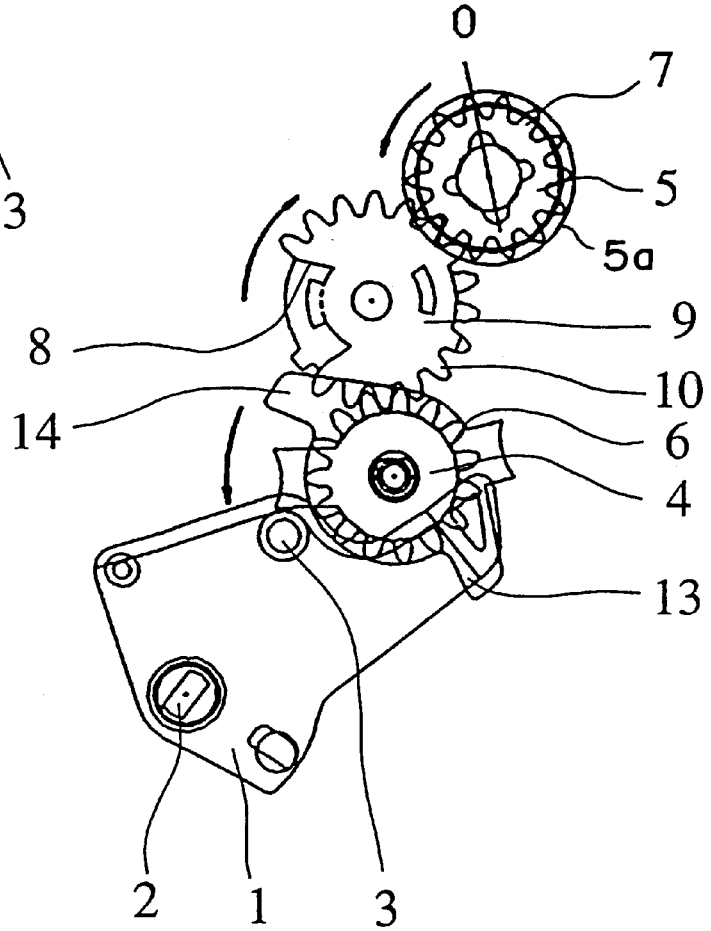
Fig. 2.9

MOTOR VEHICLE DOOR LOCK OR THE LIKE WITH TRIP-FREE MECHANISM

BACKGROUND OF THE INVENTION

1. Field of the Invention

The invention relates to a motor vehicle door lock or the like for a door or hatch of a motor vehicle which can be closed from the outside, preferably via a closing cylinder, with a lock mechanism which, among others, has an actuating lever, a force application element which moves the actuating lever, and an intermediate element which is moved away from the closing cylinder or the like. In particular, to such a lock in which the force application element and intermediate element are made as gear wheels with gear rims which are transmission-coupled to one another.

2. Description of Related Art

Motor vehicle door locks of this type are intended primarily for side doors of motor vehicles; but, theoretically, they can also be used for rear doors. Such locks have a trip-free mechanism between the closing cylinder, on the one hand, and the actuating lever in the lock mechanism, on the other. Thus, it can be distinguished whether the motor vehicle door lock is or has been locked or unlocked from the inside or outside. This differentiation between inside locking and outside locking is used for various purposes. On the one hand, an anti-theft position can be attained in which the inside locking button can no longer be set if closed from the outside, without the need for a special key position for this purpose. On the other hand, a so-called comfort circuit can be formed, specifically, when the door is closed from the outside, closing functions can be automatically triggered, for example, for a sliding roof, windows, or the like, and antennas can be retracted or an alarm system activated.

The aforementioned comfort circuit could be accomplished via a microswitch directly on the closing cylinder on the outside door handle. However, space is so limited at that location in modern motor vehicles that extremely miniaturized circuits are necessary, which are too expensive. Often, space is also so limited that a switch can no longer be used at all.

In the known motor vehicle door lock on which the present invention is based (German Patent Application No. 37 17 778), there is an intermediate element between the outside locking lever and the power transmission element. Like the power transmission element, this is part of the lock mechanism. This intermediate element in the lock mechanism allows differentiation between outside locking and inside locking, since it is effectively of a higher level than the inside locking lever, so that outside locking has priority over inside locking. The intermediate element itself triggers switching functions for the central interlock system, for example, to actuate an anti-theft lever, to activate a comfort circuit or to turn on an alarm system. In this case, the intermediate element acts on the inside locking lever, and therefore, drives the levers in the locking mechanism, via a force application element which is coupled to it, to execute limited relative motion.

In the aforementioned prior art, the intermediate element with the force application element is assembled as a two-part double nut which can turn in a bearing. The power transmission element to be caused to rotate around its longitudinal axis by the closing cylinder on the outside door handle fits, on the front side, into a flat housing in a center bearing journal of the intermediate element. Therefore, functionally, the intermediate element is placed axially on the end of the power transmission element and is entrained thereby with the rotary motion.

The design with the double nut as described above cannot be accommodated just anywhere. Instead of a double nut, sometimes a trip-free mechanism is also ensured by a slider being inserted for power transmission between the nut and switching mechanism (German Patent Application No. 40 15 522). This slider can be triggered linearly or laterally (German Patent No. 44 02 616). U.S. Pat. No. 5,050,410 shows the use of a lever slot type slider for this purpose.

Otherwise, many other versions of designs of a trip-free mechanism are known in conjunction with motor vehicle locks and power transmission from the closing cylinder into the lock mechanism (European Application Nos. A 0 558 211 & A 0 634 548, and German Patent No. 35 13 287).

If the intention is to accomplish the end stop for rotary motion of the key in the closing cylinder, not from the lock mechanism, but on the closing cylinder, the actuating lever of the lock mechanism reaches its stop before the closing cylinder has reached its stop. Therefore, it must be possible to turn the closing cylinder somewhat farther, for example, 10° to 50°, once the actuating lever is already stationary.

As has been explained above, in the prior art, in toothed gearing between the closing cylinder and actuating lever, the necessary trip-free mechanism has long been accomplished via a slider. This is not always possible for reasons of space.

SUMMARY OF THE INVENTION

In view of the foregoing, a primary object of the present invention is to provide a motor vehicle lock in which a trip-free mechanism is integrated between the closing cylinder and actuating lever in a toothed gearing without a slider.

The aforementioned object is achieved in a motor vehicle door lock or the like by the rim of one of the gear wheels having a gap and so that the intermediate element can continue to be turned in idle when this gap is reached without the force application element itself continuing to turn along with it.

The integration of a gap into the gear rim of one of the gear wheels of the gear clutch between the closing cylinders, on the one hand, and the actuating lever of the lock mechanism, on the other, is an important aspect of the invention. This gap ensures that the locking cylinder can continue to be turned over a certain angular segment in idle without the need to further move the power transmission element and with it the actuating lever. The gap in the rim of a gear wheel is an amazingly simple way for achieving the desired idle without the need to resort to a slider.

Other preferred embodiments and developments of the invention and special advantages are will become apparent from the following description of one preferred embodiment of the invention when considered together with the accompanying drawings.

BRIEF DESCRIPTION OF THE DRAWINGS

FIGS. 2.1–2.9 each show a respective one of a total of nine function positions of the motor vehicle door lock of FIG. 1 for explaining its operation.

DETAILED DESCRIPTION OF THE PREFERRED EMBODIMENT

Figure 1:
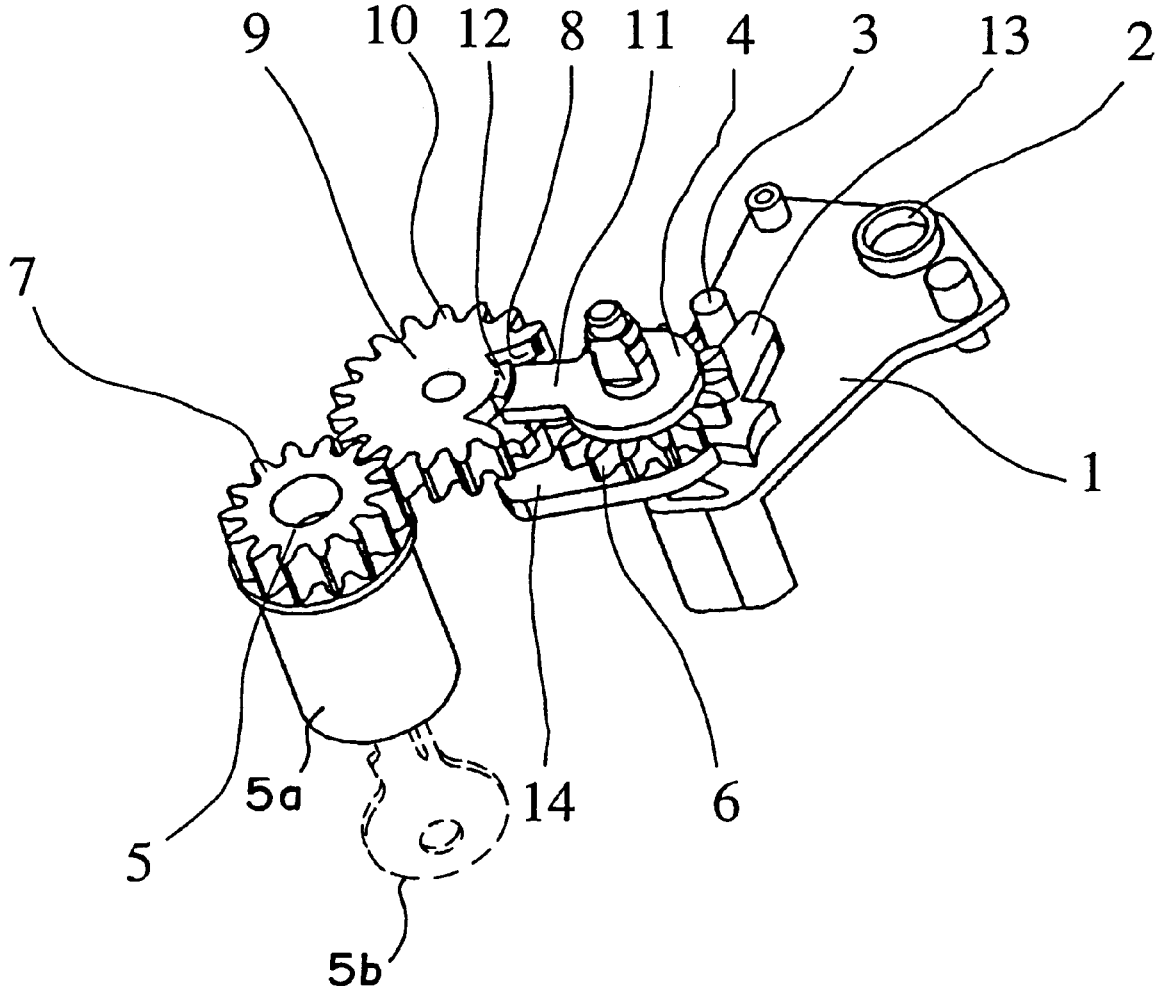
FIG. 1 is a perspective view of the area of a motor vehicle door lock or the like which is of particular importance for the understanding the teaching of the present invention.

FIG. 1 shows a portion motor vehicle door lock or the like as claimed in the invention which is important for understanding the teaching of the invention; the remainder of the lock is of conventional construction, such as that disclosed in the U.S. Pat. No. 5,050,410, which is hereby incorporated by reference to the extent necessary to complete an understanding of this invention, particularly how a trip-free mechanism would be disposed between the closing cylinder 5*a* (also referred to as a key cylinder); and the actuating lever and externally actuated via, e.g., a key 5*b*. The motor vehicle door lock of the present invention is intended and suitable for a door or hatch of a motor vehicle which can be closed from the outside, preferably via the closing cylinder 5*a*. Another lock mechanism of the motor vehicle door lock (not shown) has an actuating lever 1 which is supported to pivot about a pivot axis centered in opening 2 of lever 1. Actuating pin 3 is used to move actuating lever 1. Actuating lever 1 is moved by a force application element 4 which is likewise pivotally mounted on a pivot axis. Intermediate element 5, which is moved by the closing cylinder 5*a*, interacts with force application element 4. Force application element 4 and intermediate element 5 are made as gear wheels which are transmission-coupled to one another. Gear rims 6, 7 of the gear wheels of elements 4, 5 are apparent in FIG. 1. Intermediate element 5 is moved by the closing cylinder 5*a* via a rotary rod or paddle as the power transmission element; it is made as a so-called "nut" in the embodiment shown here.

At this point, it is important for the teaching of the invention that the rim of one of the gear wheels has gap 8 and thus intermediate element 5 can continue to be turned in idle when this gap 8 is reached without force application element 4 itself continuing to turn along with it. Actuating lever 1 and force application element 4 can therefore stop, while intermediate element 5, driven by the closing cylinder 5*a*, continues to move over a certain angular segment. This angular segment can be one of from 20° to 50°, preferably roughly 30°.

Basically, it is also possible to implement the gap 8 in rim 6 or in rim 7 of one of gear wheels of elements 4, 5. However, the preferred embodiment shown has another gear wheel, specifically transmission element 9 with corresponding gear rim 10. This transmission element 9 is located between the force application element 4 and the intermediate element 5 and is likewise made as a gear wheel which, on the one hand, engages force application element 4, and on the other hand, intermediate element 5. The gap is located in rim 10 of transmission element 9. Rim 10 of transmission element 9 is permanently engaged with rim 7 of intermediate element 5. Gap 8 is implemented relative to force application element 4 so that transmission element 9 is not permanently engaged to force application element 4.

The high degree of integration of the trip-free mechanism of the present invention is clearly illustrated by the drawings. The end stop of the closing motion can be provided on the closing cylinder 5*a*, and the last movement by turning of the closing cylinder 5*a* is initiated by the trip-free mechanism in the toothed gearing so that actuating lever 1 can stop.

As a result, after decoupling gear rim 10 of the transmission element 9 from force application element 4 by means of gap 8, the force application element 4 is not unintentionally shifted. There are additional fixing means 11, 12 by which the location of force application element 4 is fixed relative to intermediate element 5, while intermediate element 5 continues to turn in idle together with transmission element 9 in the embodiment shown. This applies to the embodiment shown. Fixing means 11, 12 could also be made directly between gear wheels 4, 5 if there were no transmission element 9. It is interesting that, in this embodiment, fixing means 11, 12 are located in a plane above the engagement plane of gear rims 6, 10 or 6, 7. In this way, they do not collide with gear rims 6, 10 or 6, 7.

The embodiment which is shown in FIG. 1, and which can be recognized especially well in FIGS. 2.1 to 2.9 in different positions, calls for fixing means 11, 12 to be made as supports which rest on one another and which are matched in an arc shape.

The embodiment shown, furthermore, makes it clear that force application element 4 is made as a cam disk which moves the actuating lever 1 via actuating cam 13 and the aforementioned actuating pin 3.

FIGS. 2.1 to 2.9 and the following will be used to explain how the construction as claimed in the invention works.

In FIG. 2.1, bottom, actuating lever 1 is shown supported on swivelling axis 2. Here, the closing cylinder 5*a* and thus intermediate element 5 are in the zero position. The arrows indicate in which direction the actuating motion takes place.

In FIG. 2.2, the closing cylinder 5*a* has been turned clockwise 50°, which is followed by counterclockwise rotation of the gear of intermediate element 5 and clockwise rotation of transmission element 9 since gear rims 6, 10 and 7, 10 engage one another. Because the gear rims 6, 10 engage one another, force application element 4 follows this rotary motion. Actuating cam 13 has approached actuating pin 3, but has not yet moved actuating lever 1.

FIG. 2.3 shows further rotation by another 20° of the closing cylinder 5*a* which initiates the actuating motion of actuating lever 1. Actuating lever 1 is swivelled in the direction of rotation shown, for example, from the locked position into the unlocked position.

FIG. 2.4 shows the end of the swivelling motion at an angle of rotation of the closing cylinder 5*a* of 90°. Here, the switching end position of the lock mechanism is reached, actuating lever 1 cannot move further, internal microswitches are triggered, control of the central interlocking system is or has already been activated. In this state, gear rims 6, 10 disengage by gap 8 having reached a position opposite gear rim 6 of force application element 4.

For actuating lever 1 which is stopped and for force application element 4, as seen below, in the transition from 2.4 to 2.5, the closing cylinder 5*a* moves over a further angle from 30 to 120°. Intermediate element 5 thus moves at the same time, likewise transmission element 9 which is coupled by toothed engagement of gear rims 7, 10. Idle is effected by gap 8.

It is apparent how force application element 4 is held in its position by fixing elements 11, 12 anyway. By means of the contour of supports 11, 12 which form the fixing elements, the contour matched in an arc shape, in spite of continued movement of transmission element 9, force application element 4 cannot continue to move, but cannot turn uncontrolled in one direction or the other either.

From FIG. 2.6 on, the reset motion begins, first when the idle is used up, and then, when gear rims 10, 6 engage again, so that finally the zero position in FIG. 2.9 has been reached again via the positions shown in FIGS. 2.7 and 2.8. This corresponds to position 1 with the difference that actuating lever 1 is in the other adjustment position.

Proceeding from FIG. 2.9 corresponding rotary motion of the closing cylinder 5*a* can also take place into the opposite direction, so that another actuating cam 14 of force application element 4 comes to rest on actuating pin 3 of actuating lever 1 and moves actuating lever 1 in the opposite direction, therefore, back again into position 1. The idle function works in exactly the same way in this direction.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Motor vehicle lock for a closure of a motor vehicle which can be closed from the outside of the motor vehicle, comprising a lock mechanism with a key cylinder externally actuated via a key, an actuating lever, a force application element which moves the actuating lever, a movable intermediate element, and a transmission element located between the force application element and the intermediate element; wherein the force application element, the transmission element and the intermediate element comprise gear wheels with gear rims which are transmission-coupled to one another with the transmission element engaging the force application element and the intermediate element; wherein the gear rim of one of the gear wheels has a gap means for enabling the intermediate element to continue to be turned in a transient phase of idle movement following a movement of the key cylinder when the gap means is reached without the force application element itself continuing to turn along with the intermediate element.

2. Motor vehicle lock as claimed in claim 1, wherein the gap means is formed in the gear rim of the transmission element.

3. Motor vehicle lock as claimed in claim 1, further comprising fixing means for fixing the location of the force application element relative to the transmission element while the intermediate element continues to turn in idle.

4. Motor vehicle lock as claimed in claim 3, wherein the fixing means are located in a plane which is out of an engagement plane of the gear rims.

5. Motor vehicle lock as claimed in claim 4, wherein the fixing means comprise supports which rest on one another and which are matched in an arc shape.

6. Motor vehicle lock as claimed in claim 5, wherein the force application element comprises a cam disk with an actuating cam which moves the actuating lever.

* * * * *